US011001792B2

(12) United States Patent
Leipold et al.

(10) Patent No.: US 11,001,792 B2
(45) Date of Patent: May 11, 2021

(54) GRANULAR CLEANING AGENT FOR BATHROOMS

(71) Applicant: BUCK-CHEMIE GMBH, Herrenberg (DE)

(72) Inventors: Joachim Leipold, Reutlingen (DE); Antje Schirmer, Rottenburg (DE); Frank Brunecker, Rottenburg (DE)

( * ) Notice: Subject to any disclaimer, the term of this patent is extended or adjusted under 35 U.S.C. 154(b) by 104 days.

(21) Appl. No.: 16/312,542

(22) PCT Filed: May 2, 2017

(86) PCT No.: PCT/EP2017/060355
§ 371 (c)(1),
(2) Date: Dec. 21, 2018

(87) PCT Pub. No.: WO2018/001603
PCT Pub. Date: Jan. 4, 2018

(65) Prior Publication Data

US 2019/0256808 A1 Aug. 22, 2019

(30) Foreign Application Priority Data

Jun. 29, 2016 (DE) ..... 102016111895.8
Aug. 30, 2016 (DE) ..... 102016116112.8

(51) Int. Cl.

| | |
|---|---|
| ***C11D 17/00*** | (2006.01) |
| ***C11D 1/04*** | (2006.01) |
| ***C11D 1/72*** | (2006.01) |
| ***C11D 1/83*** | (2006.01) |
| ***C11D 3/37*** | (2006.01) |
| ***C11D 3/43*** | (2006.01) |
| ***C11D 1/825*** | (2006.01) |
| ***C11D 3/50*** | (2006.01) |
| ***C11D 10/04*** | (2006.01) |
| *C11D 1/00* | (2006.01) |
| *C11D 1/74* | (2006.01) |

(52) U.S. Cl.
CPC ..... *C11D 17/0056* (2013.01); *C11D 1/825* (2013.01); *C11D 3/3707* (2013.01); *C11D 3/43* (2013.01); *C11D 3/50* (2013.01); *C11D 10/045* (2013.01); *C11D 17/0095* (2013.01); *C11D 1/008* (2013.01); *C11D 1/74* (2013.01)

(58) Field of Classification Search
None
See application file for complete search history.

(56) References Cited

U.S. PATENT DOCUMENTS

| | | | | |
|---|---|---|---|---|
| 5,342,550 | A * | 8/1994 | Burke | C11D 1/835 510/193 |
| 5,540,854 | A * | 7/1996 | Fair | C11D 17/006 510/152 |
| 6,689,728 | B2 | 2/2004 | Diez | |
| 2008/0269097 | A1* | 10/2008 | Cheung | C11D 17/0056 510/192 |
| 2010/0235975 | A1* | 9/2010 | Cheung | E03D 9/02 4/222 |

FOREIGN PATENT DOCUMENTS

| | | |
|---|---|---|
| DE | 102015109697 | 12/2016 |
| WO | 0111001 | 2/2001 |

* cited by examiner

*Primary Examiner* — Lorna M Douyon
(74) *Attorney, Agent, or Firm* — Mark Wisnosky

(57) ABSTRACT

An improved cleaning composition in block form is described. The composition addresses the consumer issues of having a clear product that remains clear through the life of the product and also has favorable handling properties such as a high melting point and increased hardness. The improvements are the result of three essential ingredients of particular block copolymer nonionic surfactants, alkanecarboxylic salts, and particular solvents at restricted proportions in the overall composition that are molded into a cleaning composition in block form that exhibits a high melting point, hardness and high optical transmittance.

1 Claim, No Drawings

GRANULAR CLEANING AGENT FOR BATHROOMS

The present invention relates to cleaning compositions in block form for the WC area that comprise soaps. Such cleaning compositions may be suspended, for example, in the form of rim blocks in WC cages or over the edge of the toilet bowl, using a hook attached to the composition, or else may be adhered on the toilet bowl.

Such cleaning compositions in block form ought to retain their shape even at higher temperatures; they ought to have a firm consistency and a sufficiently high melting point, allowing them to be transported and stored even in warmer climate zones and in summer without suffering any alteration in shape.

The use of soaps in toilet cleaning compositions is known. The soaps form gels with liquids and, even in small amounts, endow the composition with high strength, allowing cleaning compositions in block form with firm consistency to be obtained. Soaps are also advantageous because they are able to accommodate a high proportion of perfume oils, making the compositions suitable for fragrancing as well.

Moreover, from soaps, transparent compositions can be produced. Transparent compositions of this kind are desired by consumers for their visual appeal.

DE 197 10 635 A1 teaches a transparent, gellike toilet cleaning composition in block form which also serves for permanent room fragrancing and which comprises anionic surfactants, alkanecarboxylic salts such as sodium stearate, for example, as gel former, solvents and fragrances. The compositions there are mounted on a or in a basket or cage-like container in the toilet bowl, at a location traversed by the inflowing water at every flush.

EP 1 953 215 A1 discloses toilet cleaning compositions in block form with a particularly high transparency, these compositions comprising not only alkanecarboxylic salts, solvents, surfactants, and perfume oil but also at least one compound from the group of sugars and sugar derivatives and at least one compound from the group of the reduced sugars.

The frequent flow of flush water over the toilet cleaning composition when it is used in the toilet bowl, however, causes the transparency of the composition to reduce over time. A whitish layer is formed on the cleaning composition; the cleaning compositions "blanch". Moreover, as the number of flushes goes up, with the flow of water over the composition, there is less and less cleaning composition detached from the surface, and oftentimes there remains an insoluble, unsightly, whitish residue of the originally transparent composition in the container, which must then be removed by hand. This problem is known from the prior art. Attempts at the applicant company to prevent blanching of the composition after multiple flushes by adding complexing agents or dispersants did not result in the desired success.

EP 1 318 191 B1 discloses pastes for the sanitary sector which comprise an adhesion promoter from the group of block copolymers comprising oligoethylene or polyethylene oxide and/or oligopropylene and/or polypropylene oxide and/or oligobutylene and/or polybutylene oxide, and also water and perfume. These viscous pastes are not in block form and are also not stored in a toilet cage, instead being applied directly to the sanitary item, where they adhere and are rinsed away only after a large number of rinses.

Transparent soap bars are known from WO 01/11 001 A1 and from U.S. Pat. No. 6,689,728 B2.

The object of the present invention is to provide cleaning compositions for the WC area that are in block form, comprise alkanecarboxylic salts, dissolve completely, do not blanch, retain their transparency, and have a sufficiently high melting point.

This object is achieved by a formulation that in block form, which consists essentially of: block copolymer nonionic surfactants, alkanecarboxylic salts, and solvents, and, wherein the fraction of alkanecarboxylic salts is between 1 wt % and 5 wt %, and, the fraction of solvents is less than 40 wt %, and, the composition comprises at least 18% of the nonionic surfactants, and, the block copolymer nonionic surfactants are selected from the group of block copolymers comprising a first block comprising oligoethylene or polyethylene oxides, and, a second block comprising: oligopropylene or polypropylene oxides or oligobutylene or polybutylene oxide, and, the alkanecarboxilic salts are alkali metal salts of at least one selected from: stearic, lauric, myristic, palmitic, and oleic acid, and, the solvents comprise water, polyhydric alcohols, and, perfume oils, and, the cleaning composition has a transmittance greater than 60% at least at one point between 400 and 800 nm, has a melting point above 53° C., and, has a hardness greater than 1500 mN.

In the context of the present invention it has been found that a cleaning composition which has between 1 wt % and 5 wt % of salts of alkanecarboxylic acids, less than 40 wt % of solvents (including perfume oils), and at least 18 wt % of nonionic surfactants from the group of block copolymers comprising oligoethylene or polyethylene oxides and/or oligopropylene and/or polypropylene oxides and/or oligobutylene and/or polybutylene oxide is transparent, of firm consistency, in bar form, and sufficiently hard, has a melting point of at least 53° C., and, even when subjected many times to a flow of water over it, remains substantially transparent, and can be rinsed away completely.

The composition of the invention has a low fraction of at most 5 wt %, preferably less than 4 wt %, and more preferably less than 3 wt %, of alkanecarboxylic salts. In view of the low fraction of alkanecarboxylic salts, which ultimately, together with the alkaline earth metal ions present in the flush water, are the cause of the unsightly white deposit on the surface, blanching is avoided even under continual water flow.

In principle, however, a reduction in the fraction of alkanecarboxylic salts is accompanied by a reduction in the melting point of the composition (cf. U.S. Pat. No. 4,666,671), with the result that such cleaning compositions melt even below 50° C. and are therefore not suitable for transport and storage in hotter climates or in the summer.

In the context of the present invention it has surprisingly been found that compositions having melting points above 53° C. and being transparent and of firm consistency, and not blanching, are obtained if the composition comprises a specific nonionic surfactant, namely from the group of the above-described block copolymers, in a fraction of preferably at least 18 wt %, preferably at least 20 wt %, more preferably at least 25 wt %, with cleaning compositions having particularly high melting points being obtained at a fraction of at least 30 wt % or even at least 35 wt % of block copolymers.

In the concentration range of alkanecarboxylic salts, block copolymers, and solvents in accordance with the invention, the alkanecarboxylic salts and block copolymers, with the solvents, form sufficiently hard, transparent gels which can be rinsed away and do not blanch.

In one preferred embodiment, the composition of the invention has between 1 wt % and 5 wt % and more preferably between 2 wt % and 4 wt % of salts of alkanecarboxylic acids, more particularly alkali metal stearate, between 20 wt % and 50 wt % and preferably 35 wt % to 45 wt % of the above block copolymers, and less than 30 wt %, preferably between 18 wt % and 28 wt %, of solvents. Individual values from among these may also be present in a composition, irrespective of the presence of the other specified concentration ranges.

Salts of alkanecarboxylic acids that are used in the context of the present invention are the salts of the aliphatic or unsaturated alkanecarboxylic acids. The alkanecarboxylic salts preferably have a carbon chain with between 10 and 24 carbon atoms and are salts of monocarboxylic acids, more particularly alkali metal soaps. Particularly preferred alkanecarboxylic salts are salts of stearic, lauric, myristic, palmitic, oleic acid and/or C cuts thereof from natural or synthetic sources. On account of their biodegradability, particular suitability is possessed especially by the even-numbered, unbranched alkanecarboxylic salts with natural C source cuts.

The composition of the invention comprises at least one alkanecarboxylic salt, though it is also possible for two or more alkanecarboxylic salts to be combined with one another.

The alkanecarboxylic salts are preferably alkali metal salts and more particularly sodium and/or potassium salts.

In the context of the present invention, a block copolymer refers to macromolecules made up of blocks of two or more monomers whose chemical linkage to one another is linear, in other words heteropolymers or copolymers which consist of relatively long sequences or blocks of each monomer. The block copolymers of the invention comprise at least one oligoethylene or polyethylene oxide block. Furthermore, the block copolymer comprises a further polymer, with oligopropylene or polypropylene oxide and/or oligobutylene or polybutylene oxide being preferred as copolymers in the context of the present invention.

A high melting point, transparency, and dimensional stability of the cleaning composition are achieved, for example, with EO-PO-EO block copolymers of the following formula: $HO—(CH_2—CH_2—O)_x—(CHCH_3—CH_2—O)_y(—CH_2—CH_2—O)_z—H$. Block copolymers of this kind are available, for example, from BASF under the tradename Pluronic PE 6800 or from Kolb-Chemie under the V/23345/2 designation. Generally speaking, these block copolymers either are liquid at room temperature or have a low melting point of less than 50° C.

Instead of the PO block it is also possible to use a B(utylene) O block.

Besides the alkanecarboxylic salts and the block copolymers, the composition of the invention may comprise further surfactants; the surfactants may be selected from the group of anionic, nonioinic, cationic or amphoteric surfactants, or mixtures thereof may be provided, more particularly of anionic and nonionic surfactants.

Among the anionic surfactants, particular preference is given to the alkyl sulfates, alkyl ether sulfates, the sulfonates, such as, for example, the alkylsulfonates, the olefinsulfonates, the alkoxyalkanesulfonates, the alkylarylsulfonates such as the alkylbenzene sulfonates or the toluenesulfonates, the sulfate esters, the alkyl carbonates, alkyl ether carboxylates, the fatty acid taurides, the alkylisothionates, and mixtures thereof.

Examples of nonionic surfactants which can be used include alkyl ethoxylates such as C8-C30 alcohol ethoxylate with up to 60 EO, ethoxylated alkylphenols, ethoxylated or propoxylated fatty alcohols, sugar surfactants such as alkylpolyglycosides, polyethylene glycol ethers, ethoxylated fatty acid esters, condensation products of ethylene oxide with long-chain amines or amides, or comparable compounds, amine oxides, trisiloxane alkoxylates or mixtures thereof.

Examples of amphoteric surfactants which can be used include betaines, and examples of cationic surfactants include quaternary alkylammonium compounds. In the case of cationic surfactants, it must be ensured when carrying out selection that no neutral complexes are formed, causing clouding.

The fraction of surfactants (without the alkanecarboxylic salts and the block copolymers) is dependent on the desired cleaning and/or foam performance and is situated generally between 10 wt % and 65 wt %.

The surfactant fraction in the composition (without alkanecarboxylic salts and without block copolymers) is preferably between 15 and 40 wt % and more preferably between 20 wt % and 30 wt %.

The fraction of nonionic surfactants (without block copolymers) is preferably between 5 and 30 wt %, more particularly between 10 and 20 wt %, and very preferably between 11 wt % and 15 wt %.

The fraction of anionic surfactants (without the alkanecarboxylic salts) is generally between 5 and 30 wt %, more particularly between 10 and 20 wt %, and more preferably between 11 wt % and 15 wt %.

The total fraction of surfactants (including the alkanecarboxylic salts and the block copolymers) in the composition ought to be less than 90 wt %, preferably less than 85 wt % and more than 60 wt %, and more preferably between 65 and 75 wt %.

To obtain a sufficiently hard composition, the solvent fraction in the composition ought to be 40 wt % at most. In the context of the present invention, perfume oils are counted among the solvents. Solvents are needed so that the alkanecarboxylic salts form transparent gels. The fraction of solvents, moreover, affects the hardness of the composition. For this reason, the fraction of solvents in the composition ought preferably to be less than 30 wt % and more preferably between 20 wt % and 25 wt %.

Solvents used can be organic and/or inorganic solvents. Preferred solvents are water and alcohols, more particularly polyhydric alcohols. Examples of alcohols which may be selected include 1,2-propylene glycol, dipropylene glycol, butylene glycol, ethylene glycol, 1,7-heptanediol, glycerol, glycerol derivatives, monoethylene glycols, polyethylene glycols having a molecular weight of up to 8000, and also the mono-C1-4-alkyl ethers of the foregoing compounds. For the purposes of the present invention, sorbitols are also defined as polyhydric alcohols.

It is preferred for between 10 wt % and 20 wt % of water and between 3 wt % and 10 wt % of polyhydric alcohols to be used. The polyhydric alcohols contribute to increased transparency of the materials.

The composition of the invention may further comprise perfume oils, in an amount, for example, of 2 wt % to 20 wt %, preferably less than 10 wt %, and more preferably between 3 wt % and 6 wt %. The effect of this is to achieve long-lasting, continuous fragrance delivery and room fragrancing. Since the perfume oils also have a solvent effect, as well as fragrancing, they are also counted among the solvents in the context of the present invention.

As perfume oils it is possible generally to use individual synthetic products such as ethers, esters, aldehydes or ketones. These include, for example, benzyl acetate (ester), benzyl ethyl ether (ether), citral, citronellal (aldehyde), citronellol or eugenol (alcohols). Preference is given to using mixtures which provide a typical sensory profile.

The composition of the invention may include inorganic salts, preferably between 0 and 5%. Cumenesulfonates may be added at up to 10% as solubilizer, hydrotrop and/or clarifier.

Optionally, the composition may further comprise bleaches, oxidizing agents, anticorrosives, nanoparticles, germicides, decorative color granules and/or polymers such as PVA, cellulose or acrylamides. Adding dyes is also possible; however, if dyes are added, it must be borne in mind that the impression of transparency decreases as a result of increasing light absorption by the dyes.

The components of the composition of the invention are preferably melted together and then poured into any desired, closed mold having at least one opening, to solidify therein. Filling may take place using the known methods operating discontinuously or continuously. In comparison to the known extruded toilet cleaning compositions, which require costly and complicated mixers and extruders, the visually appealing composition of the invention can therefore be produced in a far simpler process.

The composition of the invention has a melting point of at least 53° C., preferably at least 55° C., and more preferably at least 59° C. Melting points above 60° C. are particularly preferred.

The compositions of the invention are also notable for sufficient hardness at room temperature and at temperatures of at least 53° C., preferably at least 55° C., and more preferably of more than 59° C., being of firm consistency and dimensionally stable.

The cleaning compositions of the invention have the requisite hardness when the cooled compositions at room temperature can be taken out of the mold intact and without damage on the surface. A sufficient hardness of this kind is one of the conditions allowing the composition to achieve the flush counts necessary for a toilet cleaning composition.

The compositions of the invention are transparent. A composition is transparent in the sense of the present invention if the transmittance of the composition with a layer thickness of 10 mm, measured against an empty cuvette with a path length of 10 mm, is at least 60%, preferably at least 70%. The transmittance here is determined in the visible range, i.e., between 400 nm and 800 nm, and the transmittance ought to have the above minimum transmittance at least at one wavelength in the visible range.

The flush counts of the compositions of the invention are situated in general between 80 and 400 for a 35 g block.

The pH of a 1% solution of the cleaning composition in water ought to be more than 9, so that the transparency is retained and precipitation of the carboxylic acids is prevented. The pH ought preferably to be between 9.5 and 12.

The invention is described in more detail below by means of working examples and comparative tests.

Table 1 below contrasts two inventive formulas R1 and R2 with two comparative formulas V1 and V2.

TABLE 1

| | Inventive formulas | | Comparative formulas | |
|---|---|---|---|---|
| Substance | R1 | R2 | V1 | V2 |
| Sodium alkylbenzene-sulfonate + toluenesulfonate | 14.00 | 10.00 | 10.00 | 10.00 |

TABLE 1-continued

| | Inventive formulas | | Comparative formulas | |
|---|---|---|---|---|
| Substance | R1 | R2 | V1 | V2 |
| Sodium stearate | 2.25 | 2.25 | 2.25 | 2.25 |
| C9-C11 alcohol ethoxylate with 10 EO | 12.40 | 12.00 | 21.00 | 37.00 |
| C13-C15 alcohol ethoxylate with 11 EO | | | 16.00 | |
| EO/PO block copolymer | 40.00 | 40.00 | 15.10 | 15.10 |
| Polyoxyethylene C8-C10 glycerides | 4.00 | | | |
| Sodium chloride | 2.00 | 2.00 | 2.00 | 2.00 |
| Trisodium citrate | 0.10 | 0.10 | 0.10 | 0.10 |
| Sodium cumenesulfonate | | 6.00 | 6.00 | 6.00 |
| Water | 14.50 | 16.80 | 16.80 | 16.80 |
| 1,2-Propylene glycol | 6.70 | 6.70 | 6.70 | 6.70 |
| Quinoline yellow (2% aq. solution) | <0.1 | <0.1 | <0.1 | <0.1 |
| Procion turquoise (6% aq. solution) | <0.1 | <0.1 | <0.1 | <0.1 |
| Cairo Lavender | 4.00 | 4.00 | 4.00 | 4.00 |
| Total | 100.0 | 100.0 | 100.0 | 100.0 |
| Melting point | 59.5° C. | 60.5° C. | 48.5° C. | 48.0° C. |
| Hardness/mN (T = 25° C.) | 1670 | 1640 | 990 | 900 |
| Ratio sodium stearate:block copolymer | 1:17.8 | 1:17.8 | 1:6.7 | 1:6.7 |
| Total solvent amount in wt % | 18.5 | 20.8 | 20.8 | 20.8 |
| Total surfactant amount in wt % | 68.65 | 64.25 | 64.35 | 64.35 |

The inventive formulas R1 and R2 have a melting point above 53° C., more particularly of around 60° C., whereas the compositions of the comparative formula have melting points below 50° C. and therefore, on transport or storage in warmer climates, they melt and become soft and are therefore unsuitable as cleaning compositions in block form.

Table 2 below sets out, for the substances listed in table 1, the classes of compound, the functions of the respective substances, and the chemicals employed.

TABLE 2

| Substance | Class of compound | Function | Product used |
|---|---|---|---|
| Sodium alkylbenzene-sulfonate + toluene-sulfonate | anionic surfactants | cleaning | Marlon ARL (Sasol) |
| Sodium stearate | anionic surfactants | gel former | |
| C9-C11 alcohol ethoxylate with 10 EO | nonionic surfactants | gel former | Imbentin C/91/100 (Kolb) |
| C13-C15 alcohol ethoxylate with 11 EO | nonionic surfactants | gel former | Lutensol AO 11 (BASF) |
| EO/PO block copolymer | nonionic surfactants | gel former | V/23345/2 (Kolb-Chemie) or Pluronic PE6800 (BASF) |

TABLE 2-continued

| Substance | Class of compound | Function | Product used |
|---|---|---|---|
| Polyoxyethylene C8-C10 glycerides | | foamers | Emanon XLF (Kao Chemicals) |
| Sodium chloride | inorganic salts | standardizer | |
| Trisodium citrate | oligocarboxylic salts | complexing agent | |
| Sodium cumenesulfonate | hydrotrop | clarifier | Eltesol SCS 93 (Rhodia) |
| Water | solvent | for gelling | |
| 1,2-Propylene glycol | solvent | for gelling | |
| Quinoline yellow (2% aq. solution) | dyes | | |
| Procion turquoise (6% aq. solution) | dyes | | |
| Cairo Lavender | fragrances | | |

Furthermore, the comparative tests below show that only with the block copolymers of the invention, but not other nonionic surfactants, is it possible to obtain cleaning compositions having a sufficiently high melting point.

For the comparison, the EO-PO block polymer in the inventive formula R1 in table 1 was replaced by a different nonionic surfactant, namely C13-C15 alcohol ethoxylate with 11 EO, in accordance with the formula below, and the melting point was determined:

TABLE 3

| Substance | Class of compound | Function | Product used | V3 |
|---|---|---|---|---|
| Sodium alkylbenzene-sulfonate + toluene-sulfonate | anionic surfactants | cleaning | Marlon ARL (Sasol) | 14.00 |
| Sodium stearate | | gel former | | 2.25 |
| C9-C11 alcohol ethoxylate with 10 EO | nonionic surfactants | gel former | Imbentin C/91/100 (Kolb) | 12.40 |
| C13-C15 alcohol ethoxylate with 11 EO | | gel former | Lutensol AO 11 (BASF) | 40.00 |
| EO/PO block copolymer | | gel former | | — |
| Polyoxyethylene C8-C10 glycerides | | foamers | Emanon XLF (Kao Chemicals) | 4.00 |
| Sodium chloride | inorganic salts | standardizer | | 2.00 |
| Trisodium citrate | oligocarboxylic salts | complexing agent | | 0.10 |
| Sodium cumenesulfonate | hydrotrop | clarifier | Eltesol SCS 93 (Rhodia) | — |
| Water | solvent | gel former | | 14.50 |
| 1,2-Propylene glycol | | gel former | | 6.70 |
| Quinoline yellow (2% aq. solution) | dyes | | | <0.1 |
| Procion turquoise (6% aq. solution) | | | | <0.1 |
| Cairo Lavender | fragrances | | | 4.00 |
| Total | | | | 100.0 |

The melting point of the comparative formula V3 was 43.0° C. and the hardness as measured at 25° C. was 940 mN.

This shows that high melting points are not achieved with any nonionic surfactants, but only with the EO-PO block polymers.

Hardness Measurement:

The hardnesses of the various formulas were determined as follows:

The hardness measurements were carried out using the PCE-FG 20SD force gauge from PCE Instruments (PCE Deutschland GmbH) and the "cone" stainless steel measuring tip included. For defined positioning, the force gauge instrument was mounted on the PCE-FTS50 test stand from PCE Instruments (PCE Deutschland GmbH), to ensure precise vertical displacement with a resolution of 0.01 mm.

The melted gel materials were poured into a petri dish and then stored at 25° C. for three hours to ensure hardening of the gel materials. The samples were subsequently investigated in the measurement setup described.

For the hardness measurement, the measuring tip was positioned just above the sample surface, and the measuring tip was moved downward in the direction of the sample surface in steps of 0.1 mm (lowering velocity 0.02 mm/s) and the force value at the corresponding point was stored. The hardness measurement variable used was the measured force in mN at a depth of sample penetration by the measuring tip of 2.5 mm. The zero point defined for the depth of penetration was the position at which a force was measured for the first time at the following position. The temperature during the measurement was 25° C.

What is claimed is:

1. A cleaning composition in block form for the sanitary sector consisting of formulation R1 or formulation R2 in the following table:

| Substance | Formulation WEIGHT % R1 | Formulation WEIGHT % R2 |
|---|---|---|
| Sodium alkylbenzene-sulfonate + toluenesulfonate | 14.00 | 10.00 |
| Sodium stearate | 2.25 | 2.25 |
| C9-C11 alcohol ethoxylate with 10 EO | 12.40 | 12.00 |
| block copolymer nonionic surfactants | 40.00 | 40.00 |
| Polyoxyethylene C8-C10 glycerides | 4.00 | |
| Sodium chloride | 2.00 | 2.00 |
| Trisodium citrate | 0.10 | 0.10 |
| Sodium cumenesulfonate | | 6.00 |
| Water | 14.50 | 16.80 |
| 1,2-Propylene glycol | 6.70 | 6.70 |
| Perfume Oils | 4.00 | 4.00 |
| Dye Solutions | <0.1 | <0.2 |
| Total | 100.0 | 100.0 |

wherein the block copolymer nonionic surfactants are selected from a group of block copolymers consisting of a first block consisting of oligoethylene or polyethylene oxides, and, a second block consisting of oligopropylene or polypropylene oxides or oligobutylene or polybutylene oxide.

* * * * *